US009448033B2

(12) United States Patent
Jackson

(10) Patent No.: US 9,448,033 B2
(45) Date of Patent: Sep. 20, 2016

(54) PROJECTILE LAUNCHER WITH A PERMANENT HIGH-LOW PRESSURE SYSTEM

(71) Applicant: The United States of America as represented by the Secretary of the Army, Washington, DC (US)

(72) Inventor: Paul T. Jackson, Huntsville, AL (US)

(73) Assignee: The United States of America as represented by the Secretary of the Army, Washington, DC (US)

( * ) Notice: Subject to any disclaimer, the term of this patent is extended or adjusted under 35 U.S.C. 154(b) by 630 days.

(21) Appl. No.: 13/939,372

(22) Filed: Jul. 11, 2013

(65) Prior Publication Data

US 2016/0209159 A1 Jul. 21, 2016

(51) Int. Cl.

| | |
|---|---|
| ***F41B 11/62*** | (2013.01) |
| ***F41B 11/60*** | (2013.01) |
| ***F41B 11/73*** | (2013.01) |

(52) U.S. Cl.

CPC ..... *F41B 11/60* (2013.01); *F41B 11/73* (2013.01); *F41B 11/62* (2013.01)

(58) Field of Classification Search

CPC ..... F41B 11/73; F41B 11/60; F41B 11/68; F41B 11/62; F41A 1/08; F41A 1/10

USPC ..... 124/73, 77, 75, 71, 69, 57, 74, 64, 63, 124/61, 60, 56; 42/51, 56, 55; 89/1.34, 1.3, 89/1.703, 1.706, 1.705, 1.704

See application file for complete search history.

(56) References Cited

U.S. PATENT DOCUMENTS

| | | | | |
|---|---|---|---|---|
| 2,327,653 | A * | 8/1943 | Lisle | F41B 11/62 102/430 |
| 2,466,714 | A * | 4/1949 | Kroeger | F41A 1/08 102/437 |
| 2,955,585 | A * | 10/1960 | Friedland | F41A 21/10 124/73 |
| 2,986,973 | A * | 6/1961 | Waxman | F41A 1/06 89/1.703 |
| 2,994,249 | A * | 8/1961 | Schecter | F41A 1/08 89/1.704 |
| 3,376,784 | A * | 4/1968 | Abramson | F41A 1/08 102/437 |
| 3,380,340 | A * | 4/1968 | Bergman | F41A 1/08 89/1.703 |
| 3,780,464 | A | 12/1973 | Anderson | |
| 3,815,469 | A * | 6/1974 | Schubert | F41A 1/10 89/1.1 |
| 4,283,874 | A | 8/1981 | Vaughn | |
| 4,676,136 | A * | 6/1987 | Kalin | F41A 1/10 89/1.701 |
| 4,700,499 | A | 10/1987 | Knight | |
| 4,951,644 | A * | 8/1990 | Bon | F41B 11/723 124/69 |

(Continued)

OTHER PUBLICATIONS

Corner, J., A Theory of the Interal Ballistics of the "Hoch-Und-Niederdruck Kanone", 1948.

*Primary Examiner* — John D Cooper
(74) *Attorney, Agent, or Firm* — William B. Haymond

(57) ABSTRACT

A projectile launcher includes a barrel, a high pressure chamber included within the barrel, and a low pressure area included within the barrel and substantially surrounding the high pressure chamber. The high pressure chamber includes an inner cavity and multiple vent holes connecting the inner cavity to the low pressure area so that high pressure gases generated in the inner cavity by a pressure cartridge can pass from the inner cavity to the low pressure area and propel a round (or projectile) out of the launcher.

9 Claims, 4 Drawing Sheets

(56) References Cited

U.S. PATENT DOCUMENTS

| | | | | |
|---|---|---|---|---|
| 4,962,689 | A * | 10/1990 | Phan | F41A 1/08 89/1.703 |
| 5,511,334 | A | 4/1996 | Ball et al. | |
| 5,642,583 | A | 7/1997 | Ball et al. | |
| 6,044,746 | A * | 4/2000 | Gendre | F42B 5/02 89/1.703 |
| 6,176,030 | B1 | 1/2001 | Ball | |
| 7,412,975 | B2 * | 8/2008 | Dillon, Jr. | F41B 11/62 102/440 |
| 7,481,167 | B2 | 1/2009 | Engel et al. | |
| 7,690,310 | B2 | 4/2010 | Engel et al. | |
| 7,793,644 | B2 * | 9/2010 | Lai | F41B 11/721 124/73 |
| 7,931,018 | B1 * | 4/2011 | Lai | F41B 11/721 124/71 |
| 8,833,351 | B2 * | 9/2014 | Chen | F41B 11/70 124/61 |
| 2007/0151548 | A1 * | 7/2007 | Long | F41B 11/721 124/73 |
| 2008/0105245 | A1 * | 5/2008 | Cole | F41B 11/64 124/77 |
| 2010/0012109 | A1 * | 1/2010 | Lai | F41B 11/721 124/77 |
| 2012/0255534 | A1 * | 10/2012 | Cole | F41B 11/52 124/77 |

* cited by examiner

PROJECTILE LAUNCHER WITH A PERMANENT HIGH-LOW PRESSURE SYSTEM

STATEMENT REGARDING FEDERALLY SPONSORED RESEARCH OR DEVELOPMENT

The invention described herein was made by an employee of the United States Government and may be manufactured, used, and licensed by or for the United States Government for governmental purposes without the payment of any royalties thereon.

BACKGROUND OF THE INVENTION

The present invention relates generally to projectile launchers. More specifically, the present invention pertains to a projectile launcher that includes a permanent high-low pressure system.

Projectile launchers are known in the art. These devices, which include 40×46 mm, 40×53 mm, and 25 mm grenade launchers, fire self contained cartridges that include high-low propulsion or pressure systems. Including high-low pressure systems in each round, however, increases the length, weight, and cost of each round and is undesirable in certain situations. Accordingly, there is a need for a way to reduce the length, weight, and cost of these rounds.

BRIEF SUMMARY OF THE INVENTION

The present invention addresses this need by providing a projectile launcher that includes a permanent high-low pressure system within the launcher system and not within the ammunition (or round). By including the high-low pressure system in the projectile launcher, the size, weight, and cost of the ammunition for the launcher can be reduced. In one exemplary embodiment, the projectile launcher of the present invention may include a barrel, a high pressure chamber included within the barrel, and a low pressure area included within the barrel and partially surrounding the high pressure chamber. The high pressure chamber may include multiple vent holes connecting an inner cavity included in the high pressure chamber to the low pressure area so that high pressure gases generated in the high pressure chamber by a pressure cartridge can pass from the high pressure chamber to the low pressure area and propel a round (or projectile) out of the launcher.

DETAILED DESCRIPTION OF THE INVENTION

Figure 1:
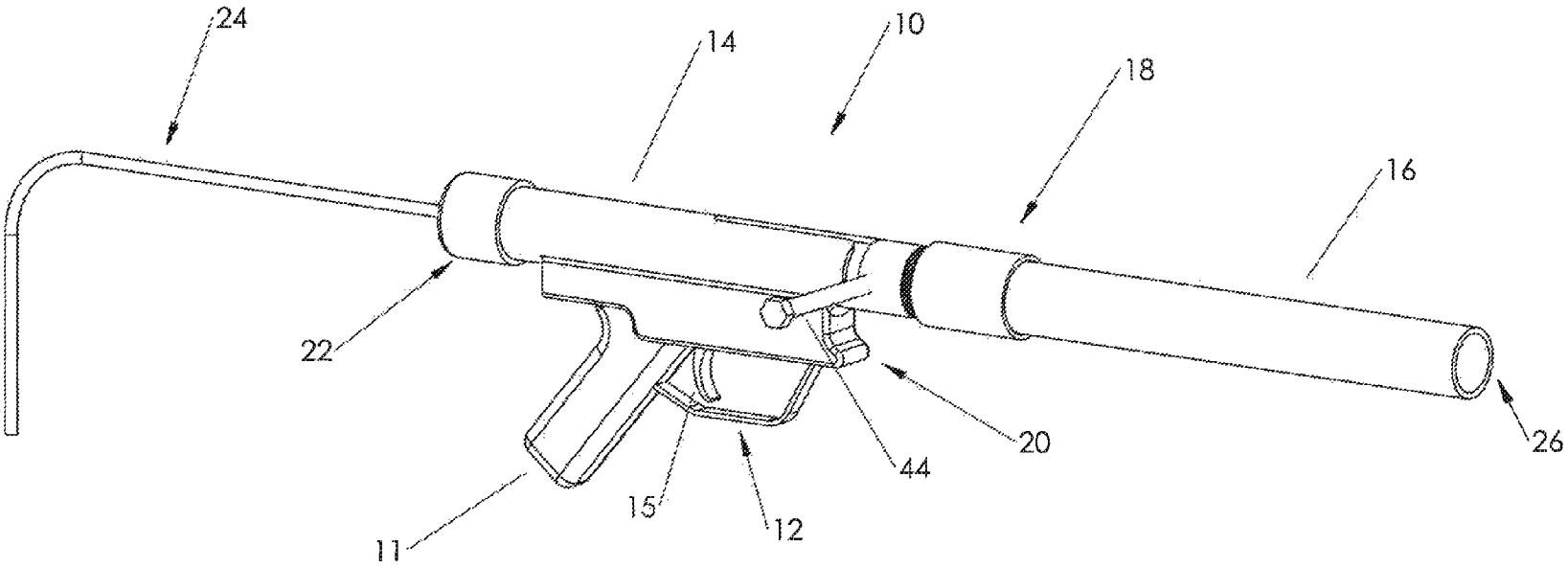
FIG. 1 is perspective view showing one embodiment of the projectile launcher of the present invention.
Figure 3:
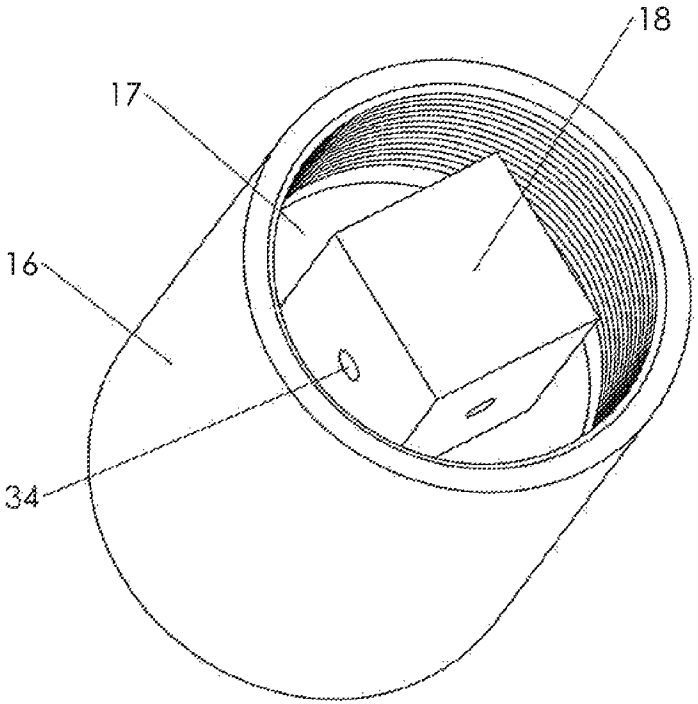
FIG. 3 is a perspective view showing the front side of the high-low pressure system of the embodiment shown in FIG. 1.
Figure 2:
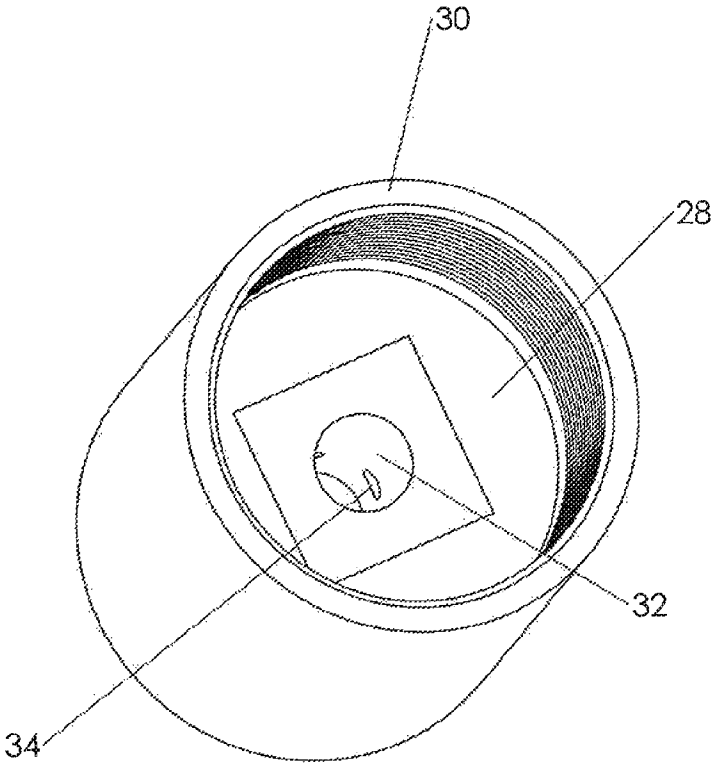
FIG. 2 is a back view showing the inner wall of the receiver and backside of the high-low pressure system of the embodiment shown in FIG. 1.
Figure 5:
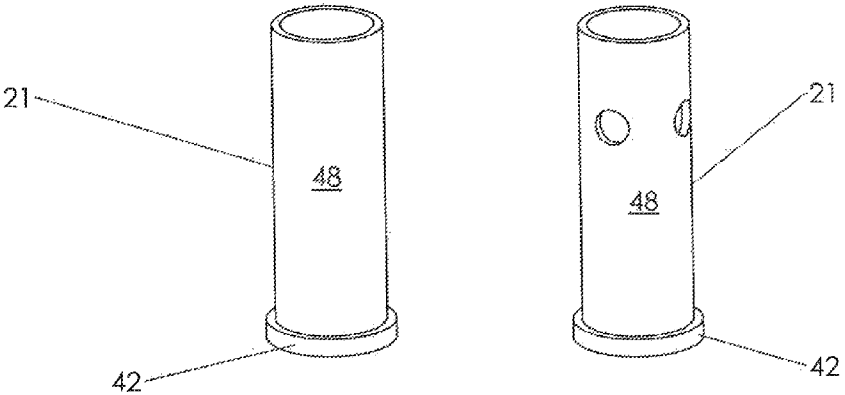
FIG. 5 is a perspective view of one embodiment of the pressure cartridge used with the present invention.
Figure 9:
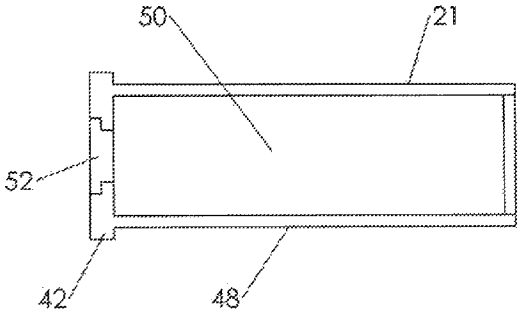
FIG. 9 is a side cutaway view of the pressure cartridge shown in FIG. 5.
Figure 8:
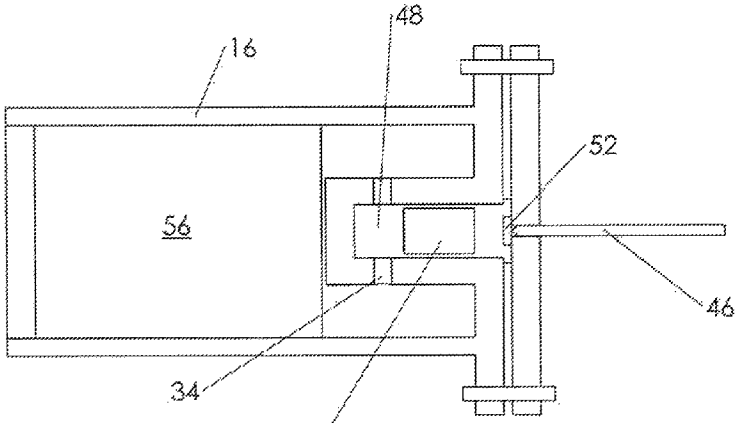
FIG. 8 is a side cutaway view showing a third embodiment of the present invention.

Referring to FIG. 1, one embodiment 10 of the projectile launcher of the present invention may include a trigger assembly 12, a receiver 14 connected to the trigger assembly 12, a rifled or unrifled launching barrel 16 connected to the receiver 14, a high pressure chamber 18 (FIG. 3) disposed within the launching barrel 16, and a low pressure area 17 substantially surrounding the high pressure chamber 18. The receiver 14 may include a bolt assembly 20 for inserting, holding, and removing a cylindrical pressure cartridge 21 (see FIGS. 5 and 9) from the receiver 14 and a firing pin assembly 22 for striking and firing pressure cartridge 21 disposed within the high pressure chamber 18. The trigger assembly 12, butt stock 24 and firing pin assembly 22 may be conventional trigger, stock and firing pin assemblies used in firearms and other types of weapons.

Figure 7:
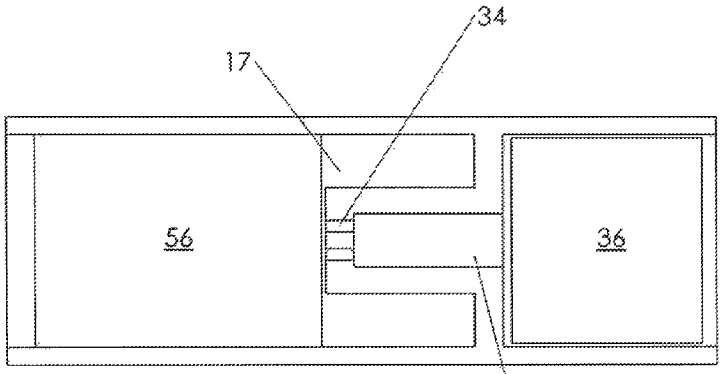
FIG. 7 is a side cutaway view showing a second embodiment of the present invention.

The launching barrel 16 may include an opening 26 on one end and an inner wall 28 disposed at an opposite end 30 of the barrel 16. The high pressure chamber 18 may extend outward into the launching barrel from a center portion of the inner wall 28 and be cylindrical, square or rectangular in shape. The high pressure chamber 18 may include a cylindrical inner cavity 32 and multiple circular vent holes 34 extending perpendicularly (FIG. 3) or horizontally (FIG. 7) outward from the cylindrical inner cavity 32. The volume of the low pressure area 17 may be greater than the volume of the high pressure chamber 18. The high volume/low volume ratio, as well as the diameters of the vent holes, may be varied to obtain different projectile velocities and pressures.

The bolt assembly 20 may include a bolt 36 having a bolt face 38 with a u-shaped notch 40 defined therein. The notch 40 may be sized to receive a cylindrical lip 42 defined on one end of the cylindrical pressure cartridge 21. The bolt assembly 20 may include a bolt handle 44 for sliding the bolt 36 in and out with respect to the high pressure chamber 18 and the cylindrical inner cavity 32, and a firing pin 46 disposed within and extending along the length of the bolt 36.

The cylindrical pressure cartridge 21 may include a cylindrical body 48 and the cylindrical lip 42 may extend perpendicularly outward therefrom. The pressure cartridge 21 (FIG. 9) may include powder 50 (such as conventional gun powder) disposed within the cylindrical body 48 and primer 52 disposed within the cylindrical body 48 adjacent to the cylindrical lip 42. The amount of powder 50 may be varied to obtain different velocities for various projectiles. The cylindrical body 48 may be metallic or manufactured out of some other suitable material that will rupture through the vent holes 34 when the cylindrical pressure cartridge 21 is fired. The cylindrical pressure cartridge 21 may fit snugly inside the high pressure chamber 18, and more specifically, cylindrical inner cavity 32, so that substantially all of the high pressure gases generated by the cylindrical pressure cartridge 21 when the cylindrical pressure cartridge 21 is fired pass through the vent holes 34 to the low pressure area 17.

Figure 6:
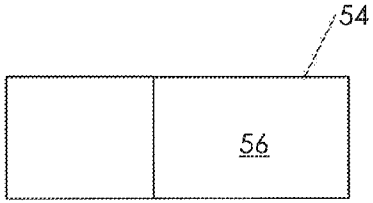
FIG. 6 is perspective view of one embodiment of a projectile used with the present invention.
Figure 4:
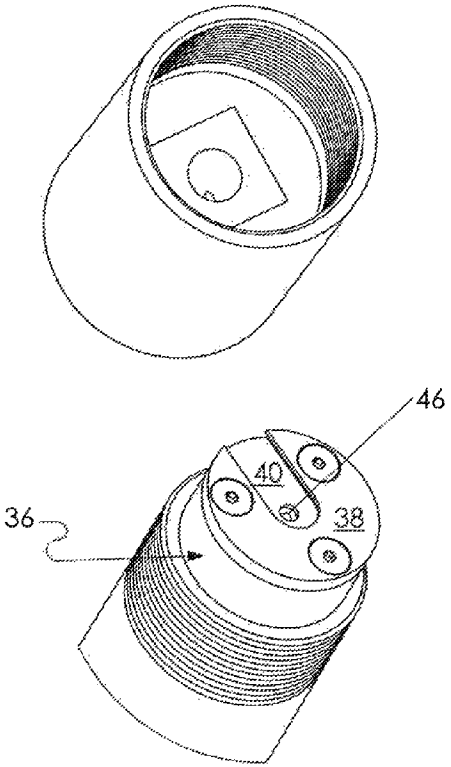
FIG. 4 is a perspective view showing the bolt included with the embodiment shown in FIG. 1.

A projectile 54 (FIG. 6) may be disposed within the launching barrel 16 adjacent to the high pressure chamber 18 and a sealing means 56 may be included between the projectile 54 and an inner surface of the launching barrel 16 to form a substantially airtight seal between the projectile 54 and the launching barrel 16. The sealing means 56 may include duct tape or rubber and the projectile 54 may include a metallic bullet, grenade style projectile, illumination flares, rubber bullet, beanbag, or tear gas canister.

The trigger assembly 12 may be connected to the firing pin 46 and operable to cause the firing pin 46 to strike and fire the cylindrical pressure cartridge 21 when it is disposed within the high pressure chamber 18, and more specifically, cylindrical inner cavity 32, and a trigger 15 included with the trigger assembly 12 is operated. The trigger assembly 12 may be connected to a hand grip 1 for holding the launcher 10.

The above-described embodiments are merely possible examples of implementations set forth for a clear understanding of the principles of this disclosure. Many variations and modifications may be made to the above-described embodiments without departing substantially from the spirit and principles of the disclosure. All such modifications and variations are intended to be included herein within the scope of this disclosure and protected by the accompanying claims.

What is claimed is:

1. A projectile launcher, comprising:

a barrel having an opening on one end and an inner wall disposed within the barrel at an opposite end of the barrel from the opening;

a high pressure chamber disposed within the barrel and extending outward from the inner wall of the barrel, the high pressure chamber including an inner cavity and a plurality of vent holes extending outward from the inner cavity to an outer surface of the high pressure chamber;

a low pressure area disposed within the barrel and substantially surrounding the high pressure chamber, the plurality of vent holes extending between and connecting the inner cavity of the high pressure chamber to the low pressure area so that high pressure gases generated in the inner cavity can pass from the inner cavity to the low pressure area; and a bolt assembly connected to the barrel for inserting, holding, and extracting a cylindrical pressure cartridge from the high pressure chamber, the bolt assembly including a bolt having a bolt face, the bolt face including a u-shaped notch defined therein and sized to receive and hold a cylindrical lip defined on one end of the cylindrical pressure cartridge, the bolt assembly further including a bolt handle for sliding the bolt in and out with respect to the high pressure chamber and a firing pin disposed within and extending along the length of the bolt.

2. The launcher of claim 1, wherein the high pressure chamber extends perpendicularly outward from a center portion of the inner wall of the barrel, the high pressure chamber is square, and the inner cavity is cylindrical.

3. The launcher of claim 2, wherein the high pressure chamber has a center axis and the plurality of vent holes extend outward either perpendicular from or parallel to the center axis, each one of the plurality of vent holes is circular, and the low pressure area volume is greater than the high pressure chamber volume.

4. The launcher of claim 3, further comprising the cylindrical pressure cartridge, the cylindrical pressure cartridge including a cylindrical body having a cylindrical lip extending perpendicularly outward from one end, powder disposed within the cylindrical body, and primer disposed within the cylindrical body adjacent to the cylindrical lip.

5. The launcher of claim 4, wherein the cylindrical pressure cartridge is manufactured out of a material that ruptures when the cylindrical pressure cartridge is fired and the cylindrical pressure cartridge fits snugly inside the high pressure chamber so that substantially all of the high pressure gases generated by the cylindrical pressure cartridge when the cylindrical pressure cartridge is fired pass through the plurality of vent holes to the low pressure area.

6. The launcher of claim 5, further comprising a projectile disposed within the barrel adjacent to the high pressure chamber and sealing means for forming a substantially airtight seal between the projectile and the barrel.

7. The launcher of claim 6, further comprising a trigger assembly connected to the firing pin disposed within the bolt, the trigger assembly operable to cause the firing pin to strike and fire the cylindrical pressure cartridge inserted into the high pressure chamber when a trigger included in the trigger assembly is operated.

8. The launcher of claim 7, further comprising a hand grip connected to the trigger assembly for holding the launcher.

9. The launcher of claim 8, wherein the sealing means includes duct tape or rubber and the projectile is a metallic bullet, grenade style projectile, illumination flares, rubber bullet, beanbag, or tear gas canister.

* * * * *